United States Patent [19]

Sarto

[11] 4,102,314

[45] Jul. 25, 1978

[54] CRANKCASE VENTILATION

[75] Inventor: Jorma O. Sarto, Orchard Lake, Mich.

[73] Assignee: Chrysler Corporation, Highland Park, Mich.

[21] Appl. No.: 782,671

[22] Filed: Mar. 30, 1977

[51] Int. Cl.[2] ..... F02F 9/00

[52] U.S. Cl. ..... 123/119 B

[58] Field of Search ..... 123/119 B

[56] References Cited

U.S. PATENT DOCUMENTS

| | | | |
|---|---|---|---|
| 3,595,211 | 7/1971 | Brehob | 123/119 B |
| 3,661,128 | 5/1972 | Eshelman | 123/119 B |
| 3,673,997 | 7/1972 | Sawada | 123/119 B X |
| 3,750,634 | 8/1973 | Nakajima et al. | 123/119 B |
| 3,990,419 | 11/1976 | Itakura | 123/119 B |

*Primary Examiner*—Carlton R. Croyle
*Assistant Examiner*—Leonard E. Smith
*Attorney, Agent, or Firm*—Baldwin & Newtson

[57] ABSTRACT

A gas make-up conduit extends to the crankcase of an internal combustion engine from the latter's fuel and air supply conduit at a location upstream of the throttle valve in said conduit and downstream of the fuel supply into said conduit to supply a mixture of fuel and air to the crankcase in the same ratio that is supplied to the engine, thereby to replace gases that are recycled according to conventional practice from the crankcase into the induction conduit downstream of the throttle valve.

6 Claims, 2 Drawing Figures

CRANKCASE VENTILATION

BACKGROUND AND SUMMARY OF THE INVENTION

This invention relates to improved means for ventilating the crankcase of an internal combustion engine and enabling the recycling of crankcase gases for combustion in the engine without significantly impairing engine driveability or the control of exhaust emissions.

In order to avoid exhausting piston blow-by products or gases of an automobile engine to the atmosphere, it has been conventional to recycle the blow-by gases via a recycling conduit from the crankcase into the fuel-air induction conduit downstream of the carburetor, where such blow-by gases are mixed with the inlet fuel-air mixture and then distributed to the engine cylinders for combustion therein. Such recycling is feasible because the blow-by products primarily comprise a gaseous fuel-air mixture in approximately the same fuel to air ratio as the metered inlet fuel-air mixture that is supplied to the engine, as for example by means of a typical carburetor or fuel injection system.

During engine idling the blow-by gases are a minimum but the pressure differential between the crankcase (which is preferably maintained at essentially atmospheric pressure) and the inlet induction conduit downstream of the throttle is a maximum. Maximum recycling would result without some provision to the contrary. Accordingly a crankcase ventilation control valve is customarily provided in the recycling conduit to control the recycling flow as an inverse function of the aforesaid pressure differential, which usually ranges from more than approximately fifteen inches of mercury during engine idling to less than approximately five inches of mercury at wide open throttle when the blow-by gases are a maximum.

In order to prevent sub-atmospheric pressures in the crankcase during engine idling and moderate load conditions, it has been customary to supply clean filtered atmospheric air to the crankcase via an air make-up conduit. However such make-up air dilutes the blow-by gases in the crankcase that are subsequently recycled to the engine as aforesaid. In consequence the problem of supplying fuel and air in the desired ratio to the engine is complicated and is rendered particularly difficult where the engine is adapted to operate on a very lean fuel mixture. Poor driveability and exhaust emission control result.

An object of the present invention is to provide an improved, simple, and effective means for recycling the crankcase blow-by gases without appreciably affecting the metered fuel-air ratio desired for engine driveability and exhaust emission control.

A more specific object is to replace the customary air make-up conduit by a fuel-air make-up conduit opening into the crankcase from the fuel-air inlet conduit or induction conduit at a location between the fuel supply means for that conduit and the usual throttle valve. Thus during normal engine operation except at idle as described below any make-up gases flowing into the crankcase via the make-up conduit will have the same fuel to air ratio as the fuel-air mixture desired for engine operation.

In a typical carburetor, a choke valve is commonly provided in the induction conduit upstream of the fuel inlet for the purpose of enriching the inlet fuel supply during certain engine operating conditions. During cranking for example, when the engine is cold the choke valve is normally closed to effect a reduced pressure at the main fuel inlet upstream of the throttle, as required to induce fuel flow for starting the engine. In some situations, it is difficult to achieve the aforesaid reduced pressure because gases from the crankcase (at substantially atmospheric pressure during cranking) flow via the make-up conduit into the induction conduit. It is accordingly another object to assure the aforesaid reduced pressure during cranking by providing where necessary a check valve assembly in the make-up conduit effective to enable comparatively unrestricted gas flow into the crankcase, as for example during idle or operation under moderate load, and to restrict the make-up conduit against gas flow therein from the crankcase until a predetermined minimum pressure differential exists between the crankcase and the induction conduit.

Other objects of this invention will appear in the following description and appended claims, reference being had to the accompanying drawings forming a part of this specification wherein like reference characters designate corresponding parts in the several views.

Figure 1:
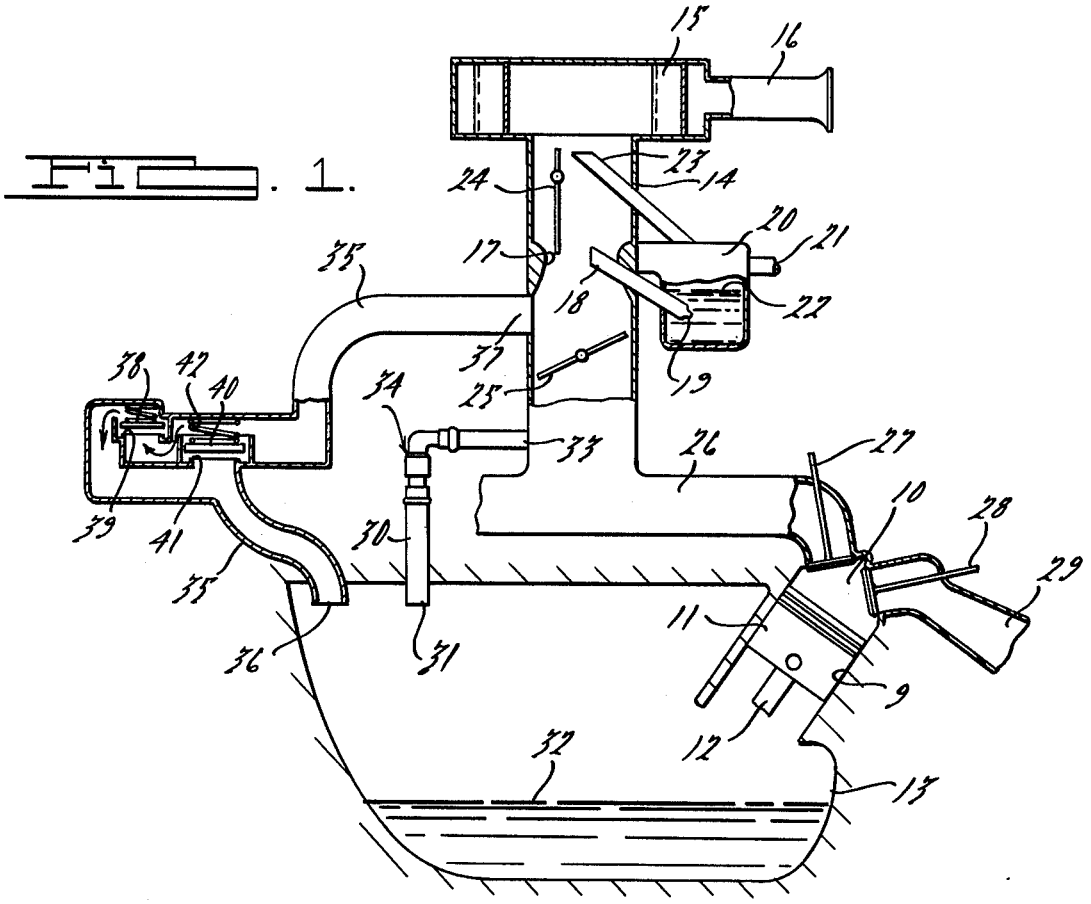
FIG. 1 is a diagrammatic view showing portions of an automobile engine including the crankcase, carburetor, and a crankcase ventilating system embodying the present invention.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

An application of the present invention is illustrated by way of example with a conventional automobile engine comprising a plurality of cylinders, such as the cylinder 9, each communicating upwardly with a combustion chamber 10 and having a piston 11 reciprocal therein and connected by means of a rod 12 with a crankshaft (not shown) contained within a crankcase 13. Fuel and air are supplied in a predetermined ratio to the combustion chamber 10 in the present instance by means of a typical carburetor system comprising a fuel and air supply conduit or induction conduit 14 connected to the atmosphere via a conventional air filter 15 and inlet snorkel 16. It will be apparent that any conventional fuel system, such as fuel injection, can replace the carburetor system shown provided that the fuel is added at a location upstream of the throttle valve 25.

In the present instance, a venturi 17 is provided in the conduit 14 and a fuel supply nozzle 18 opens into the conduit 14 at a low pressure region of the venturi 17 to aspirate fuel via a metering restriction 19 at the lower end of the nozzle 18 submerged in a fuel bowl 20. The latter is connected by conduit 21 with a fuel pump and fuel supply tank (not shown) and is maintained at a substantially constant fuel level 22 above the restricted opening 19 by means of a float controlled valve, not shown, all in a conventional manner.

The fuel within the bowl 20 is maintained at substantially atmospheric pressure by means of a pitot tube 23 opening into the conduit 14 immediately below the air cleaner 15. Immediately below the opening of tube 23 into the conduit 14 and upstream of the venturi 17 is a conventional choke valve 24, which may be an unbalanced blade type valve pivotally mounted in the conduit 14 and responsive to various operating parameters of the engine to vary the pressure at the upper discharge end of the fuel nozzle 18 to effect a moderate fuel enrichment of the fuel-air mixture during engine warm-up conditions and also to initiate fuel flow from nozzle 18 to start the engine during cranking, as is conventional.

Downstream of the venturi 17 is a conventional throttle valve 25 also pivotally mounted within the conduit 14 for controlling the flow of the combustible fuel-air mixture at the aforesaid predetermined ratio into an inlet header 26 which distributes the mixture to the several combustion chambers 10. Inlet and exhaust valves 27 and 28 respectively synchronized with the engine operate in a customary manner to admit the fuel-air mixture into the chamber 10 and to exhaust the combustion products into an exhaust conduit 29.

During the combustion cycle, as the piston 11 is driven downwardly in the cylinder 9 by the force of the expanding hot gases, a small percentage of the inlet mixture (known as blow-by gases or products) is inevitably forced into the crankcase 13 via the annular clearance between the wall of the cylinders 9 and the piston 11. Because of the comparatively small cross sectional dimension of the latter clearance and also because of the usual engine cooling system which maintains the wall of cylinder 9 comparatively cool, the fraction of the fuel-air inlet mixture that blows into the crankcase 13 does not ignite during the combustion process and thus enters the crankcase 13 in substantially the same fuel to air ratio that is supplied to the intake manifold 26 from the carburetor.

The proportion of combustion products that blow past the piston 11 into the crankcase 13 is comparatively small because, by the time combustion has proceeded sufficiently to provide such products, the piston 11 is near the lower end of its power stroke. The resulting pressure of the combustion products above the cylinder 11 is accordingly considerably reduced and the blow-by gases into the chamber 13 at that stage of the cycle are correspondingly small.

The blow-by gases within the crankcase 13, which as aforesaid have substantially the same fuel to air ratio as the inlet mixture supplied via manifold 26, are recycled into the conduit 14 by means of a first or recycling conduit 30 having an upstream opening 31 into an upper portion of the crankcase 13 remote from the level 32 of the crankcase oil. The conduit 30 enters a low pressure region of the conduit 14 at 33 downstream of the throttle 25. Thus the pressure within the crankcase 13, which is maintained approximately atmospheric, causes a positive flow of crankcase gases into the sub-atmospheric pressure of the conduit 14 at 33.

Inasmuch as the pressure at 33 is a minimum during engine idling when the throttle valve 25 is at its closed or idle position, at which time the blow-by flow from chamber 10 into crankcase 13 is a minimum, a crankcase ventilating valve 34 is provided in the conduit 30 to restrict the latter as an inverse function of the pressure differential between the crankcase 13 and port 33 in order to provide a predetermined minimum recycling flow during engine operation at idle and moderate load conditions and to progressively increase the recycling flow from crankcase 13 into conduit 14 as the latter pressure differential decreased toward wide open throttle conditions.

In order to assure proper recycling of the blow-by gases from the crankcase 13 and to provide a crankcase pressure excessively above atmospheric, the conduit 30 and valve 34 are designed to recycle the blow-by gases during all except approximately wide open throttle conditions at a greater rate than such gases enter crankcase 13. Also, in order to prevent a crankcase pressure below atmospheric, a second or make-up gas flow conduit 35 is provided with an opening 36 into the crankcase 13 adjacent the opening 31 and an opening 37 into the conduit 14 at a location downstream of the fuel inlet 18 and upstream of the throttle 25. A carbureted fuel-air mixture at substantially the same ratio as the mixture that is supplied to the intake manifold 26 is thus supplied to the crankcase 13 via conduit 35 when the engine is operating at greater than idle. By virtue of conduit 30, the crankcase pressure is less than the pressure at port 37. If the fuel for warm idle operation is supplied to conduit 14 downstream of throttle 25, as is conventional, fresh air will be supplied via 37, 35 to the crankcase 13 during idle, thereby to reduce the fuel/air ratio of the mixture in the crankcase 13 that is conducted via 30, 33 to 14. The conventional idle fuel supply (not shown) will of course be enriched to compensate for such dilution. During cold idle, the mixture flowing via 37, 35 to the crankcase 13 will be enriched by fuel from 18 in accordance with operation of the choke valve 24.

During engine operation at moderate loads, including cruise and moderate acceleration, the make-up gases flowing via 35, admix with the blow-by mixture within the crankcase 13 and are discharged therefrom via 31, 30 and 33 into the fuel-air mixture that then flows via intake manifold 26 into the combustion chamber 10. It is apparent that such make-up gases merely bypass the throttle 25 and do not dilute the resultant fuel-air mixture that is supplied to the combustion chamber 10, so that engine driveability and the control of undesirable exhaust emissiions are not impaired.

By the construction described thus far, during engine idling and operation at all but near wide open throttle conditions, the low pressure at port 33 results in a recycling flow via conduit 30 from crankcase 13 into conduit 14 and a make-up flow via conduit 35 into crankcase 13. At high load near wide open throttle conditions, the blow-by flow past piston 11 may exceed the recycling flow via conduit 30. In this situation, a reverse flow through make-up conduit 35 will conduct crankcase gases from port 36 to port 37. In any event, the fuel-air ratio of the gases flowing in conduits 30 and 35 will be substantially the same as the ratio in the intake manifold 26.

The proper fuel supply at 18 for starting the engine during cranking requires a predetermined minimum pressure differential across the choke valve 24. Accordingly in some instances a check valve assembly is provided in the conduit 35 to prevent a reverse flow of gases therein from the crankcase 13 into conduit 14 at 37 until a predetermined minimum pressure differential exists between ports 36 and 37. The check valve assembly comprises a light weight valve disk 38 adapted to seat at an annular valve seat 39. A similar check valve disk 40 seats at an annular valve seat 41 and may be maintained seated by a light spring 42, or merely by gravity. In the latter event the valve disk 40 will be appreciably heavier than the valve disk 38.

As is apparent in FIG. 1, the check valve assembly provides two flow paths through the conduit 35. Make-up flow from port 37 to port 36 during usual operation, i.e. except during engine cranking and heavy load conditions near wide open throttle, is provided through annular seat 39. During such flow, valve disk 38 unseats without offering a significant resistance to the flow and valve disk 40 positively closes the opening defined by annular seat 41. The reverse flow from port 36 to port 37 is permitted only through annular check valve seat 41 upon the unseating of check valve 40. During such flow, check valve 38 completely closes the opening defined by annular seat 39. The weight of valve 40 and the force of spring 41 if such is employed are predetermined so that valve 40 will not unseat until the pressure differential thereacross exceeds the light pressure sufficient to assure proper response of the fuel supply to operation of the choke valve 24, which may be on the order of less than approximately one-half inch of mercury. Accordingly, during engine cranking, gas flow from the crankcase 13 into conduit 14 at 37 will not interfere with the reduced pressure induced at the nozzle 18 by the cranking until the reduced pressure is adequate to cause opening of valve 40. Engine starting fuel will thus flow into conduit 14 via nozzle 18. The check valve assembly 38, 40 is most useful to assist cold starting when choke 24 is closed and when the cranking power is nominal. During normal starting with adequate cranking power, the check valve assembly 38, 40 is not required.

In order to prevent an uncontrolled bypassing of throttle valve 25 via ducts 35 and 30, the crankcase ventilating control valve 34 is designed to restrict conduit 30 as a predetermined function of the pressure in conduit 14 downstream of the throttle valve 25, which latter pressure is a function of the extent of throttle opening. Thus the flow through conduits 35 and 30 bypassing the throttle 25 is controlled as a predetermined function of the throttle opening, as desired for engine operation under varying load conditions.

Figure 2:
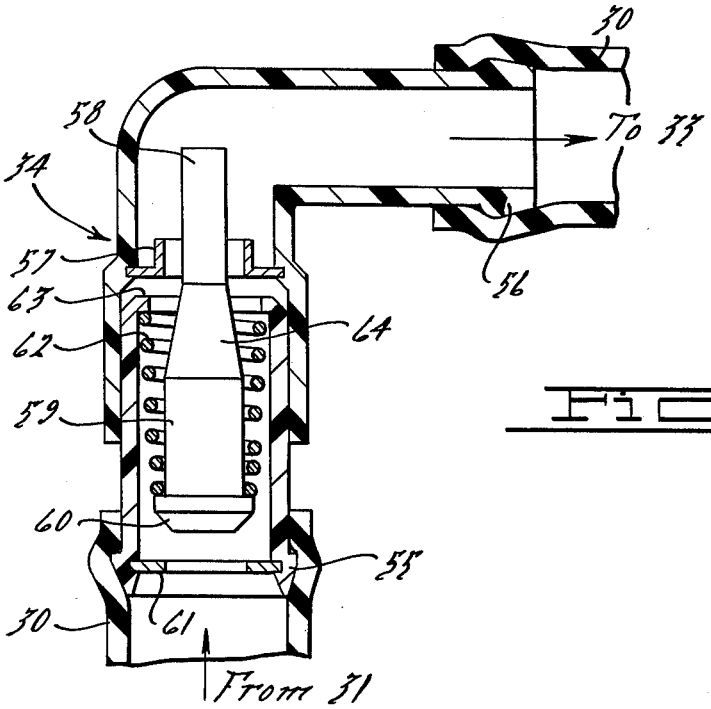
FIG. 2 is an enlarged longitudinal sectional view through the crankcase ventilating flow control valve.

The crankcase ventilating valve 34 may be conventional and may comprise a valve of the type illustrated in U.S. Pat. No. 3,661,128 to which reference may be made for further details of operation and construction. Referring to FIG. 2, the valve 34 comprises a two part elbow shaped tube defining a portion of conduit 30. The valve 34 has an upstream end 55 secured to the portion of the conduit 30 extending from port 31 and has a downstream end 56 secured to the portion of conduit 30 leading to port 33. A vertical leg of the tube 34 contains an annular metering orifice member 57 through which the entire flow in tube 34 must pass. A reduced cylindrical nose extension 58 of a valve plunger 59 extends coaxially upward into the central metering opening of member 57.

The lower end of plunger 59 comprises an enlarged base 60 adapted to seat at an annular end closure 61 upstream of the plunger 59 to close the valve 34 to fluid flow therethrough in the event of an engine back-fire that would blow plunger 59 downwardly. A coil spring 62 frictionally engages the body of the plunger 59 and yieldingly holds the nose 58 at the wide open position illustrated with respect to the annulus 57, with the base 60 suspended above the annular seat 61.

The upper portion of the spring 62 is secured within the vertical leg of the valve tube 34 at a location below the annulus 57 and is prevented from upward movement by an annular spring retainer 63 integral with the tube 34. A conical metering portion 64 of the plunger 59 is adapted to enter the central metering opening of annulus 57 to progressively restrict the latter as the pressure differential between the ends 55 and 56 increases. During idle operation, the upper end of the nose 58 abuts the bend of the elbow of tube 34 to effect the maximum restriction for the metering opening 57. As the pressure differential between the ends 55 and 56 decreases with increasing engine load, the spring 62 urges the plunger 59 downwardly to decrease restriction to gas flow and thereby to enable increased recycling flow through conduit 30. Valve 59, spring 62, and the metering restriction 57 are dimensioned to effect a substantially constant recycling flow through conduit 30 during idle and cruise operation of the engine and thereafter to increase the recycling flow progressively as the engine load increases toward the wide open throttle condition.

I claim:

1. In an internal combustion engine having a combustion chamber comprising a cylinder opening into a crankcase, a piston movable within said cylinder and separating the combustion chamber from the crankcase, a fuel-air supply conduit, throttle means in said conduit, means for effecting a mixture of fuel and air in a predetermined ratio in said conduit upstream of said throttle means, and means for connecting said conduit downstream of said throttle means with said combustion chamber for supplying said mixture thereto, the combination of means for recirculating piston blow-by gases from said crankcase into said supply conduit at approximately said predetermined ratio of fuel and air comprising first conduit means for connecting said crankcase with said supply conduit at a location downstream of said throttle means, and second conduit means connecting said crankcase with said supply conduit at a location upstream of said throttle means for supplying said mixture to said crankcase whenever the pressure in the latter is less than the pressure upstream of said throttle means.

2. In the combination according to claim 1, means for effecting a predetermined minimum differential between the pressure in said crankcase and the pressure in said supply conduit upstream of said throttle means during predetermined operation of said engine comprising check valve means in said second conduit means for enabling comparatively unrestricted fluid flow therein from said supply conduit into said crankcase and for effecting a predetermined restriction to fluid flow in said second conduit means from said crankcase to said supply conduit.

3. In the combination according to claim 1, flow control valve means responsive to the differential between the pressure in said supply conduit downstream of said throttle means and the pressure in said crankcase for restricting said first conduit means as a function of said pressure differential.

4. In the combination according to claim 3, means for preventing fluid flow in said second conduit means from said crankcase to said supply conduit until the pressure in said crankcase exceeds the pressure in said conduit upstream of said throttle means by a predetermined minimum differential comprising check valve means in said second conduit means for enabling comparatively unrestricted fluid flow therein from said supply conduit into said crankcase and for effecting a predetermined restriction to fluid flow in said second conduit means from said crankcase to said supply conduit.

5. In the combination according to claim 1, said means for effecting said mixture comprising means for supplying fuel to said supply conduit at a fuel inlet upstream of said throttle means and an air inlet in communication with the atmosphere and opening into said supply conduit for supplying air thereto upstream of said fuel inlet, choke valve means in said supply conduit upstream of said fuel inlet for controlling the fluid pressure at said fuel inlet, and means for preventing fluid flow in said second conduit means from said crankcase until the pressure in the latter is greater than the pressure in said supply conduit at said fuel inlet by a predetermined minimum differential comprising check valve means in said second conduit means for enabling comparatively unrestricted fluid flow therein from said supply conduit into said crankcase and for effecting a predetermined restriction to fluid flow in said second conduit means from said crankcase to said supply conduit.

6. In the combination according to claim 5, flow control valve means responsive to the differential between the pressure in said supply conduit downstream of said throttle means and the pressure in said crankcase for restricting said first conduit means as a function of said pressure differential.

* * * * *